United States Patent [19]

Widnall

[11] 4,276,248

[45] Jun. 30, 1981

[54] METHODS FOR FORMING FIBROUS WEBS

[75] Inventor: Sheila E. Widnall, Lexington, Mass.

[73] Assignee: American Can Company, Greenwich, Conn.

[21] Appl. No.: 89,925

[22] Filed: Oct. 31, 1979

[51] Int. Cl.[3] ..... D04H 1/00

[52] U.S. Cl. ..... 264/121; 19/89

[58] Field of Search ..... 264/121; 19/156.3, 89

[56] References Cited

U.S. PATENT DOCUMENTS

| | | | |
|---|---|---|---|
| 2,969,104 | 1/1961 | Schubert et al. | 264/121 |
| 3,834,869 | 9/1974 | Ancelle et al. | 264/121 |
| 4,004,323 | 1/1977 | Gotchel et al. | 19/156.3 |
| 4,081,501 | 3/1978 | Muther | 264/121 |

*Primary Examiner*—Donald E. Czaja
*Assistant Examiner*—J. R. Hall
*Attorney, Agent, or Firm*—Robert P. Auber; George P. Ziehmer; Paul R. Audet

[57] ABSTRACT

This invention relates to methods for forming a nonwoven fibrous web on a foraminous forming surface moving at a velocity in excess of about 500 feet per minute. In forming satisfactory uniform webs, the fibers are conveyed to the forming surface in a gaseous stream whereby the relative surface-to-fiber velocity along the moving surface is maintained within a critical ratio relative to the fiber velocity normal to the moving surface.

9 Claims, 6 Drawing Figures

METHODS FOR FORMING FIBROUS WEBS

BACKGROUND OF THE INVENTION

This invention relates to methods for depositing a layer of fibers from a gaseous suspension of fibers onto a moving foraminous forming surface. More specifically, this invention sets forth improvements in the methods of achieving high speed production of nonwoven fibrous webs.

In the production of nonwoven webs, the prior art has generally disclosed systems which form an air suspension of fibers and direct the suspended fibers toward a moving foraminous forming surface upon which the fibers from the suspension are condensed to form the nonwoven web. Various apparatus exist for generating the air suspension of fibers; for example, fibers can be produced by a lickerin, a hammermill, or by other apparatus known in the art. The fibers can be dispersed in a gaseous medium by a variety of methods, and conveyed to a forming surface in an air stream operating generally as a pressure flow system, a vacuum system or a closed loop system. Applicant has found that critical process limitations exist in the production of such air laid nonwoven webs, in that in a given system as the speed of the forming surface increases, the uniformity of the formed web tends to decrease. It has been found that particularly at commercial speeds above about 550 feet per minute, fiber lay-down on the moving forming surface tends to become uneven in the machine direction, with the deposited webs exhibiting an upper surface having an undulated, wave-like or ripple effect extending in the cross-machine direction, and with the webs exhibiting corresponding variations in thickness and in basis weight. This rippling effect becomes more pronounced as the speed of the forming surface increases, with the spacing between the thicker portions of the web becoming greater and with the web becoming more varied along its surface as to basis weight. This rippling effect worsens with increased speed of the forming surface, and eventually renders the webs commercially unacceptable at some higher speed. This invention is directed at significantly alleviating the detrimental ripple effect. Applicant has determined that there exists a critical relationship between the velocity of the fibers relative to the velocity of the moving forming surface as the fibers are being deposited onto the forming surface. Applicant has further determined that the detrimental ripple effect can be controlled by controlling the ratio of the tangential velocity of the fibers relative to the moving forming surface, as compared to the velocity of the fibers normal to the moving surface.

Some prior art has been concerned with obtaining higher production speed in the production of air laid webs. In U.S. Pat. No. 4,004,323, issued to Gotchel et al., for example, it is taught that speeds in excess of 200 feet per minute can be achieved by inclining a duct, which carries a stream of fibers, at an angle to a forming surface. The patent teaches a range of incidence angles of the duct relative to the forming surface of from about 10° to about 30°. Gotchel fails, however, to teach the high speed formation limitation termed herein the rippling effect, nor does Gotchel contain any teaching as to the criticality of the velocity ratios as between the fibers and the forming surface in alleviating the detrimental rippling effect. Indeed, the present invention teaches that there are combinations of fiber stream velocities and forming surface velocities for which ducts aligned as recommended in Gotchel will produce unacceptable webs with pronounced ripples.

SUMMARY OF THE INVENTION

This invention relates to methods for forming a nonwoven fibrous web on a foraminus forming surface moving at a speed in excess of about 500 feet per minute. The methods include distributing the fibers uniformly in a gaseous medium to form a gaseous suspension of fibers. The gaseous suspension of fibers is conveyed in a stream to the moving forming surface onto which the fibers from the gaseous suspension are deposited to form a nonwoven fibrous web.

In the methods of the invention the detrimental high-speed forming phenomenon termed the rippling effect is alleviated by controlling the critical relationship between the velocity of the fibers being deposited onto the moving forming surface, relative to the velocity of the moving surface. For a web substantially comprising fibers of a papermaking length generally less than $\frac{1}{4}$ inch, a commercially acceptable product is obtained by maintaining the velocity of a gaseous stream containing the fibers in a particular relation to the velocity of the forming surface: for a forming surface having a velocity $V_0$, and a gaseous stream of fibers having a velocity component $V_1$ in the direction of motion of the forming surface and a velocity component $V_2$ normal to the forming surface, $V'$, the magnitude of the difference between velocity $V_0$ and velocity component $V_1$, should be less than about three times the normal fiber velocity $V_2$. When the velocities are retained within this ratio, the air-laid product is generally acceptable in terms of the ripple effect web characteristics; outside this ratio the air-laid product generally is unacceptable as having excessive ripple characteristics.

In more complicated flows, wherein the gaseous stream containing the fibers has, in addition to the aforementioned velocity components, a velocity component $V_3$ in the cross machine direction, the magnitude of the relative velocity component of the gaseous stream tangential to the forming surface, $V'$, is equal to the square root of the quantity $(V_0-V_1)^2$ plus $(V_3)^2$. In this case also, the velocity $V'$ should be less than about three times the normal fiber velocity $V_2$.

Operation within the critical relationship between the fiber velocities relative to the forming surface velocity can be implemented in a variety of methods. For a given velocity $V_0$ of forming surface, the normal fiber velocity $V_2$ can be increased, for example, by increasing the amount of suction pulling the gaseous stream through the moving surface. As a second example, the gaseous stream can be deflected to impinge upon the forming surface at an oblique angle, thereby increasing the velocity component $V_1$ of the gaseous stream in the direction of motion of the forming surface while maintaining velocity $V_2$ constant by increasing the amount of suction. In either approach the ratio of the velocity of the fibers relative to the velocity of the moving forming surface, compared to the component of the fiber velocities normal to the forming surface, can be varied to produce more acceptable product having more uniform web characteristics.

DESCRIPTION OF THE PREFERRED EMBODIMENTS OF THE INVENTION

Applicant has found that the high speed production of air laid webs is severely limited by a non-uniformity of web formation herein termed the ripple effect. This invention teaches alleviating the detrimental ripple effect by controlling the critical relationships between the velocity of fibers in a gaseous stream being condensed on a moving foraminous forming surface, relative to the velocity of the moving surface.

Figure 1A:
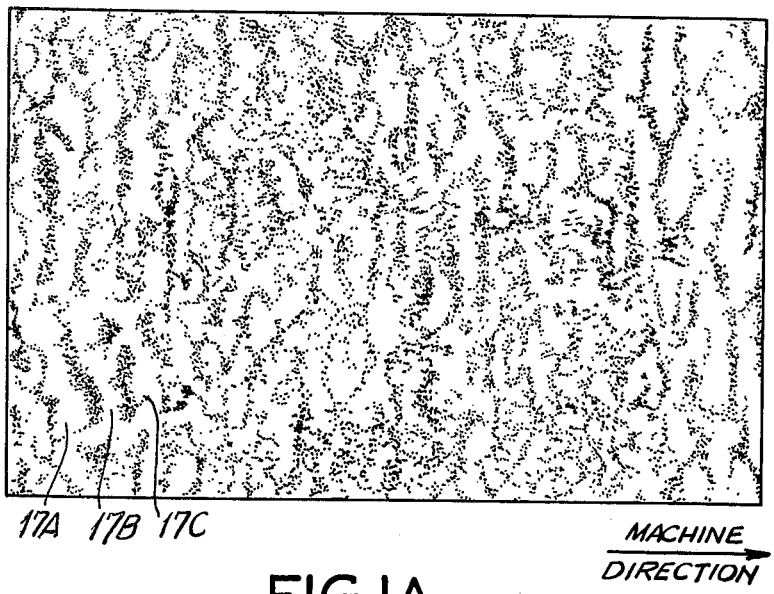
FIGS. 1A and 1B illustrate air laid webs produced at velocity ratios of 2.5:1 and 3.5:1, respectively.
Figure 2A:
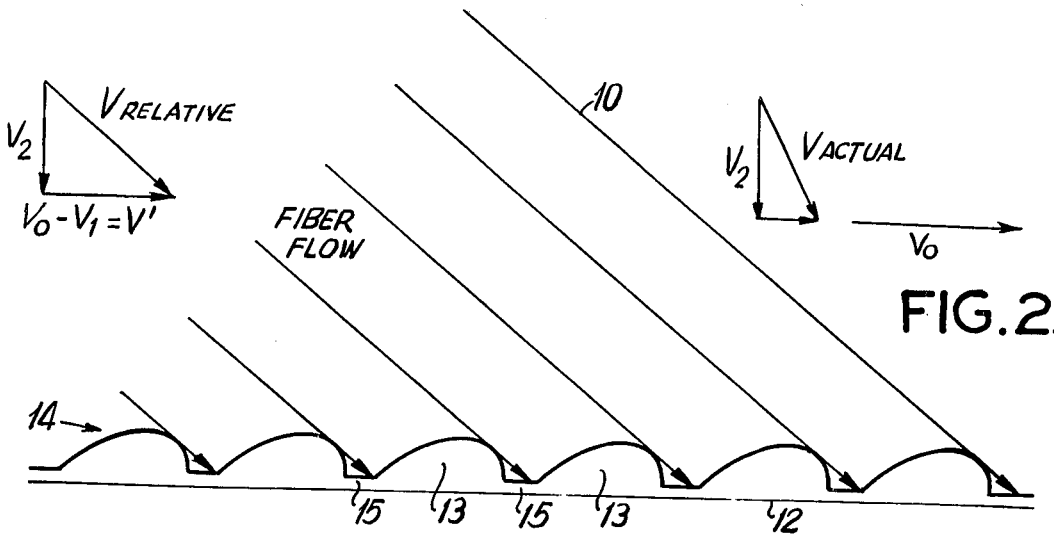
FIGS. 2A and 2B are diagrams illustrating the ripple effect at velocity ratios of 1.3:1 and 4:1, respectively.
Figure 2B:
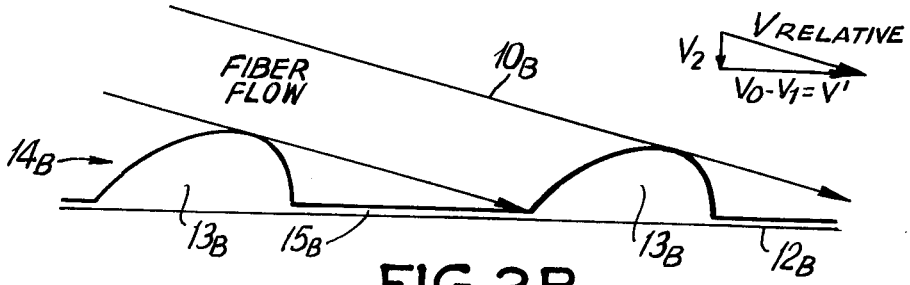

FIGS. 2A and 2B illustrate two conditions of air laid web formation under two differing velocity conditions as viewed relative to the surface 12. In FIG. 2A, typical fiber paths, 10, illustrate fibers approaching a forming surface 12 at an overall relative velocity V (relative), relative to the surface 12. As shown, this overall relative velocity V (relative) is how an oncoming fiber would be viewed from a stationary point riding on the moving surface 12. The relative velocity, therefore, is the vector sum of the actual fiber velocity, here shown as V (actual) which has vector components $V_2$ normal to the forming surface and $V_1$ parallel to the forming surface 12. When viewed relative to the forming surface 12 moving at a velocity $V_0$, the velocity $V_1$ is subtracted from the $V_0$ component to obtain the fiber velocity V' relative to the surface 12. The magnitude of the sum of $V_0-V_1$ therefore represents the relative velocity of the oncoming fiber at a direction along the forming surface, and $V_2$ represents the velocity of the oncoming fiber in the direction normal to the forming surface. Applicant has determined that a critical parameter in the formation of a web as illustrated in FIG. 1A is the ratio of V' to the fiber velocity $V_2$ normal to the surface. Applicant has found that in forming a nonwoven fibrous web substantially comprising fibers of a papermaking length generally less than ¼ inch, that this ratio must be maintained below about 3:1 to obtain acceptable product in terms of uniformity of the web, i.e. in terms of the inherent ripple effect.

FIG. 2A further illustrates this ripple effect and applicant's present belief of the reasons for the nonuniform web formation. FIG. 2A illustrates a nonwoven web 14 formed of fibers deposited, as illustrated, along fiber paths 10. As the fibers are deposited on the forming surface 12, the fibers approach the surface at an oblique angle as viewed in a coordinate system moving with the forming surface. The ripple effect is believed to be primarily caused by a "shadowing" effect caused by the oblique approach of the fibers to the surface 12. This shadowing begins with the first fiber deposits, which occur randomly on the surface 12. These fiber deposits cause "shadows" directly downstream from their positions generally preventing oncoming fibers from falling in the areas of the shadows. Fiber continues to accumulate directly upstream from these initial deposits such as in thicker web portions 13 until the shadowing influence of a neighboring upstream deposit interferes. With further fiber deposition there is an apparent linking up of fiber deposits 13 in the cross machine direction to form the characteristic ripple effect. As is apparent from FIG. 1A, this shadowing phenomenon produces the ripple effect with thicker web portions 13 alternating with thinner web portions 15. Further fiber deposition only increases the ripple characteristic of the web without changing the ripple wavelength. Except for some possible fiber bouncing or slipping during the initial deposition of fibers onto a surface, no fiber bouncing or slipping has been observed in the formation of webs below a velocity ratio of about 3:1. At ratios above about 3:1, fiber bouncing or slippage was observed to be a more significant forming phenomenon, with the resulting web exhibiting extremely nonuniform web characteristics.

FIGS. 2A and 2B illustrate the relation between the nonuniformity of web formation, i.e. the ripple effect, and the ratios between the fiber and forming surface velocities. In FIG. 2A, V', the difference between velocity $V_0$ of the moving surface 12 and velocity component $V_1$ of the fibers in the direction of motion of the surface, is about 1.3 times the velocity $V_2$ of the fibers normal to the moving surface, i.e. a ratio of 1.3. The resulting web, 14, is relatively uniform with closely spaced thicker web portions 13. In FIG. 2B, V' the difference between velocity $V_0$ of the moving surface $12_B$ and velocity component $V_1$ of the fibers in the direction of motion of the surface, is about four times that of velocity $V_2$ of the fibers normal to the moving surface $12_B$, (a ratio of 4:1) and the resulting web $14_B$ is much less uniform than the web 14 of FIG. 2A, with a more pronounced ripple effect, i.e. with the thicker portions $13_B$ of the web more widely spaced and of greater relative basis weight than in the web 14 of 2A.

FIGS. 2A and 2B illustrate fiber velocities having components $V_1$ in the direction of motion of the forming surface and $V_2$ normal to the forming surface. No fiber velocity components in the cross-machine direction, i.e. perpendicular both to velocity component $V_1$ and to velocity component $V_2$, have been illustrated since such velocity components are generally undesirable in the manufacture of air laid webs. In instances where such cross-machine velocity components do in fact exist, such velocity components $V_3$ may affect the web formation since those cross-machine velocity components will increase the relative velocity V' by the following formula, V' is equal to the square root of $(V_0-V_1)^2+(V_3)^2$, and thereby affect the velocity ratio $V':V_2$. Such cross machine velocities $V_3$ may deleteriously affect the web, requiring corresponding adjustments to reduce V' or increas $V_2$ in those affected web areas.

Figure 1B:
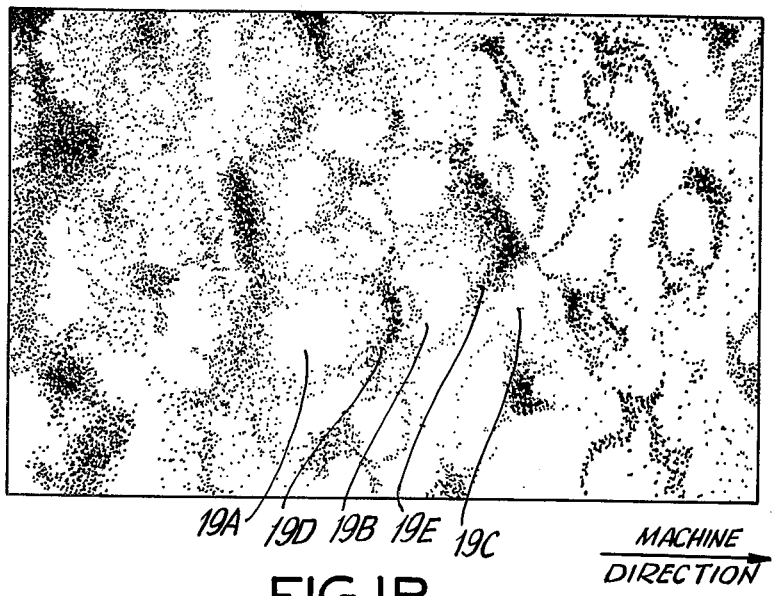

FIGS. 1A and 1B are plan views of webs formed at velocity ratios of 2.5:1 and 3.5:1, respectively. As seen in FIG. 1A, at the lower 2.5:1 ratio, the web produced is relatively uniform, exhibiting the ripple effect to a minor, acceptable degree. Some variation in fiber deposit is evident, with recurring heavier deposits at, for example, 17A, 17B, 17C. As seen in FIG. 1A, the distances between these uniformly recurring heavier deposits 17A, 17B, 17C can be measured and are termed the "wavelength" of the "ripples." As seen in FIG. 1B, web formed at a velocity ratio of 3.5:1 exhibits a ripple effect of far greater wavelength with thicker portions 19A, 19B, 19C, interspersed with thinner portions 19D and 19E. The web of FIG. 1B is far less uniform in basis weight than the web of FIG. 1A and is generally unacceptable.

Figure 3:
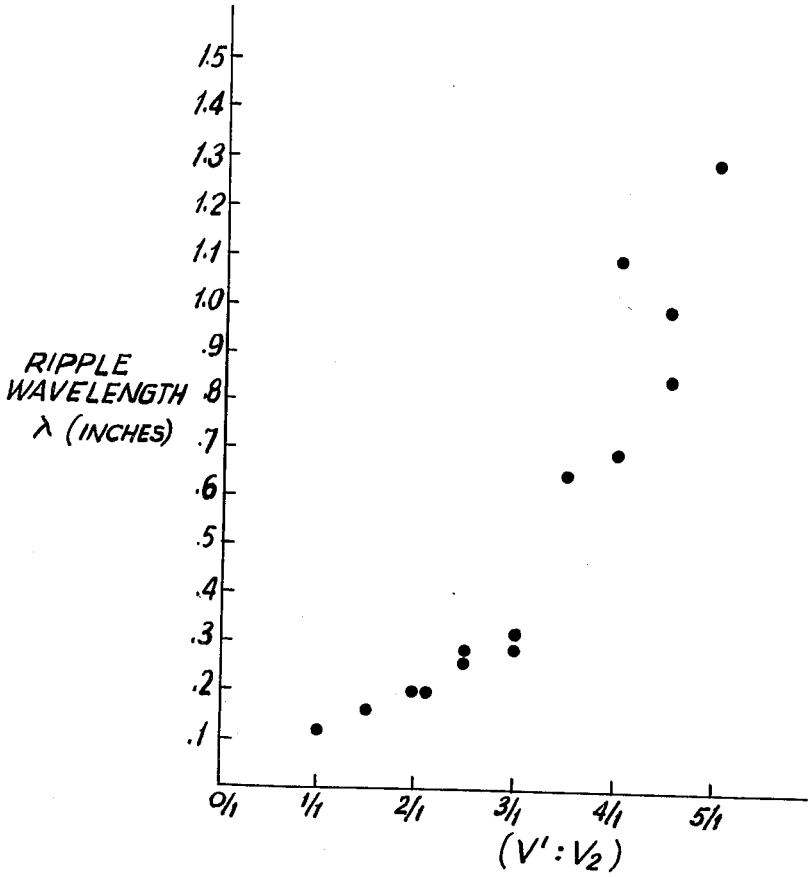
FIG. 3 is a graph illustrating the ripple wavelength for velocity ratios of from 1:1 to 5:1.

FIG. 3 is a graph illustrating experimental results of studies as to the ripple effect, for velocity ratios of the absolute value of the vector sums $(V_0-V_1)$, relative to $V_2$, ranging from 1:1 to 5:1. These studies were conducted using softwood Kraft and included studies of other variables in the air laid forming process in order to verify the criticality of this velocity ratio parameter.

The tests verified that the ratio results as illustrated by FIG. 3 are independent of the absolute speeds involved, from about 250 feet per minute up to a forming surface speed of about 2250 feet per minute. It is believed that the ratio results are independent of speed at speeds lower than 250 feet per minute and greater than 2250 feet per minute. Other tests verified that the ratio results as illustrated by FIG. 3 are generally independent of the foraminous forming surface used for web formation at ratios of below 3:1. Most of the tests were conducted using a 59 (MD)×42 (CD) brass forming wire, 0.0095 inch (MD) and 0.0115 inch (CD). Other tests verifying these ratio results were conducted on wires: 40 (MD)×32 (CD), bronze, 0.0112 inch (MD)×0.0125 inch (CD); 78 (MD)×64 (CD), bronze, 0.0067 inch (MD)×0.00725 inch (CD); 108 (MD)×64 (CD) double-weave polyester 0.00866 inch (MD)×0.00866 (CD), top, and 0.0118 (CD) bottom; and 84 (MD)×32 (CD) two-layer polyester, 0.0157 inch (MD)×0.0157 inch (CD).

As shown in FIG. 3, up to the critical velocity ratio of approximately 3:1, the ripple wavelength, as defined above, increases to a minor degree with an increase in the ratio. Air laid fibrous product produced under conditions of a velocity ratio of 3:1 or less, was generally considered to be acceptable in terms of uniformity of web density. Product produced at conditions of greater than a 3:1 velocity ratio was judged unacceptable in that the variances in web basis weight and thickness, the ripple effect, were too great. As seen in the graph of FIG. 3, above the 3:1 ratio the variation in web characteristics becomes extremely disproportionate to a variation in velocity ratio, thereby establishing the criticality of the 3:1 limit.

Most of the studies establishing the criticality of the velocity ratio of 3:1 were conducted using softwood Kraft fibers which are relatively long cellulosic natural fibers. Use of fibers of other sizes would vary the ripple effect in terms of the wavelength but would not affect the criticality of the 3:1 ratio. For example, use of a shorter natural fiber such as a hardwood fiber, will cause less of the shadowing problem and will tend to shorten the wavelength in the web for a given velocity ratio.

Since lowering the velocity ratio will lower the ripple wavelength for a given length of fibers, the actual ratio at which the fibrous product is produced for commercial application can be varied to obtain a desired product. For example, it may be desired to produce fibrous product comprised substantially of softwood Kraft fibers at a velocity ratio of 2.5:1 for commercial purposes since that product would exhibit more uniform web characteristics than if produced at a 3:1 velocity ratio. Similarly, the fibrous product could be varied as to its composition, varying the fiber sizes to vary the ripple effect at a given velocity ratio. For example, a mixture of hardwood and softwood fibers might constitute commercially acceptable fibrous product at a higher velocity ratio than for a product produced primarily of softwood fibers.

As stated above, the wavelength of the ripple effect is independent of the overall basis weight of the deposited web. As the web is being deposited onto the forming surface, the spacing between the thicker portions of the web (the ripple wavelength) is established early during the deposition of the fibers, and further fiber deposition only increases the web thickness without affecting this ripple wavelength. For commercial purposes, a lower weight web, such as a tissue product, might be produced at a lower velocity ratio to shorten the ripple wavelength, obtaining a more satisfactory commercial product in terms of minimizing the effect of the thinner web portions 15. It is believed that this invention can be used to produce air laid webs at least in the range of from about 7 to about 75 pounds per 3000 square feet of web.

Figure 4:
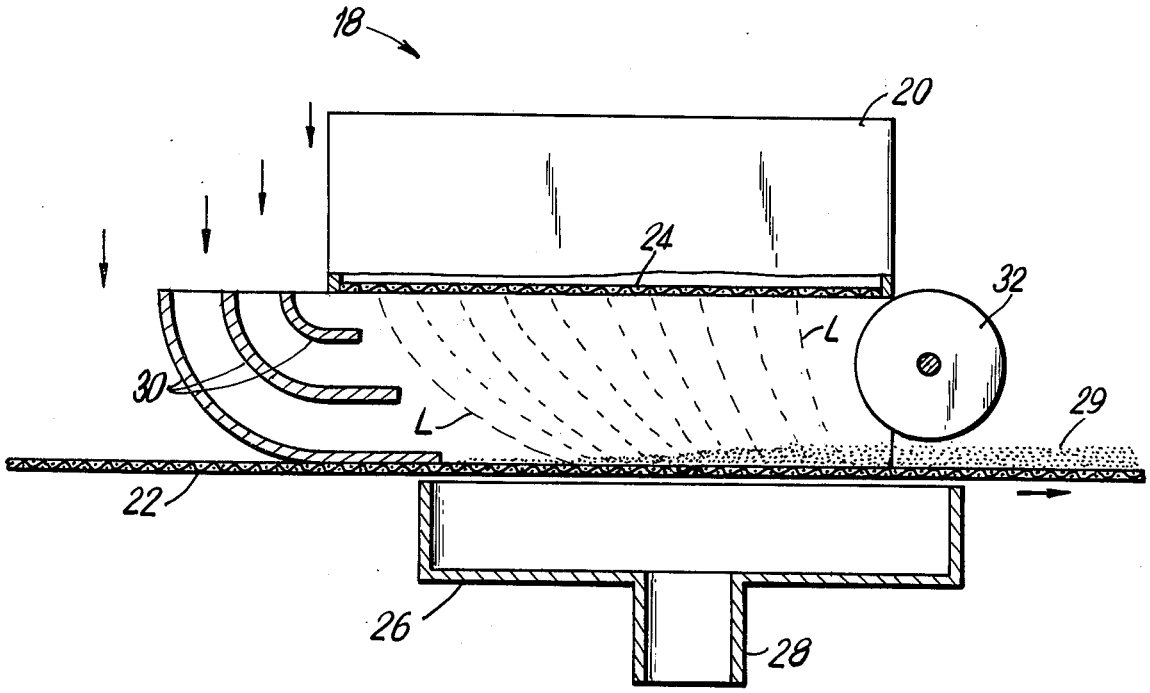
FIG. 4 is a horizontal view of apparatus illustrating the use of this invention, with partial cutouts for clarity.

The apparatus of FIG. 4 illustrates an application of this invention to enable the production of acceptable air-laid web at a higher speed of production than previously possible.

In FIG. 4, apparatus 18 comprises a conventional distributor 20 positioned above a moving foraminous forming surface 22 moving from left to right in the drawing in the direction shown, with cellulosic fibers being impelled from the bottom 24 of the distributor 20 to form an air suspension of fibers directed toward the forming surface 22. A suction box 26 is positioned below the forming surface 22, offset somewhat in the downstream direction, with the suction box 26 creating a moving air stream downwardly through the forming surface 22 and out exhaust pipe 28 to a fan (not shown).

The air stream fibers flow from the bottom 24 of the distributor box to the portion of the moving surface 22 above the suction box 26 where the fibers are deposited in the form of an air laid web 29. In this stream of fibers, the individual fibers are brought onto the moving surface 22 at an oblique angle by means of both the action of the offset position of the suction box 26 as well as by air turning foils 30. The turning foils 30 are positioned adjacent the upstream end of the distributor 20 and generally serve to introduce a horizontal air stream into the stream of fibers flowing from the distributor 20 to the forming web 22. Sealing roll 32 is positioned along the downstream end of distributor 20 to substantially seal the space between the distributor 20 and the forming surface 22. Side seals, not shown, seal the sides of the apparatus. These seals reduce air loss and minimize air turbulence within the apparatus.

The horizontal air stream introduced by the turning foils 30 operates with the offset suction box 26 to impart a horizontal component of velocity to the fibers within the airstream. The dashed lines L in FIG. 4 indicate typical probable paths of fibers and illustrate that the fibers approach the moving surface 22 at an oblique angle having a velocity component in the direction of the moving wire thereby enabling the production of an acceptable air laid web at a higher speed of the forming surface 22 in accordance with this invention.

What is claimed:

1. A method for forming upon a foraminous forming surface a nonwoven fibrous web having fibers therein less than about ¼ inch in length, comprising the steps of:

(a) moving a forming surface at a velocity $V_0$ exceeding 500 ft./minute;

(b) distributing said fibers into a gaseous stream to form a suspension therein;

(c) conveying the gaseous suspension of fibers in a stream at an angle to said moving surface, said gaseous stream of fibers having a first velocity component $V_1$ parallel to the direction of motion of said moving surface, and a second velocity component $V_2$ normal to the direction of motion of said moving surface;

(d) establishing conditions wherein the ratio of the absolute value of $V_0$–$V_1$, relative to $V_2$, is less than about three, and;

(e) depositing said fibers in said gaseous stream upon said foraminous moving surface to form said non-woven fibrous web.

2. The method of claim 1 wherein said fibers are comprised substantially of softwood Kraft fibers, and wherein the ratio of the absolute value of $V_0$–$V_1$, relative to $V_2$, is less than about two and one-half.

3. The method of claim 1 wherein said foraminous forming surface is a screen having a cross machine direction and a machine direction, said screen having about forty brass wires per inch in the cross machine direction, each wire being about 0.0115 inch in diameter; and about sixty brass wires per inch in the machine direction, each wire being about 0.0095 inch in diameter.

4. The method of claim 1 wherein said fibrous web has a basis weight in the range of from about 7 pounds to about 75 pounds per three thousand square feet of web.

5. The method of claim 1 wherein said fibrous web has a basis weight in the range of from about 25 pounds to about 70 pounds per three thousand square feet of web.

6. The method of claim 1 wherein said fibrous web has a basis weight in the range of from about 30 pounds to about 45 pounds per three thousand square feet of web.

7. The method of claim 1 wherein the ratio as set out in step (d) is less than about two and one-half.

8. The method of claim 1 wherein the ratio as set out in step (d) is less than about two.

9. The method of claim 1 or 6 wherein said gaseous stream has a velocity component $V_3$ in a direction perpendicular to both velocity component $V_1$ and to velocity component $V_2$; and wherein the ratio of the magnitude of the square root of $(V_0-V_1)^2+(V_3)^2$, relative to $V_2$, is less than about three.

* * * * *